United States Patent [19]

Ngo

[11] 4,328,489

[45] May 4, 1982

[54] SELF-SHIFT AC PLASMA PANEL USING TRANSPORT OF CHARGE CLOUD CHARGE

[75] Inventor: Peter D. T. Ngo, Colts Neck, N.J.

[73] Assignee: Bell Telephone Laboratories, Incorporated, Murray Hill, N.J.

[21] Appl. No.: 109,859

[22] Filed: Jan. 7, 1980

[51] Int. Cl.[3] ..... G09G 3/28

[52] U.S. Cl. ..... 340/713; 340/792; 340/805; 340/768; 315/169.2

[58] Field of Search ..... 315/169.1, 169.2; 340/768, 805, 714, 713

[56] References Cited

U.S. PATENT DOCUMENTS

| | | | |
|---|---|---|---|
| 3,878,430 | 4/1975 | Hirose | 340/768 |
| 3,881,129 | 4/1975 | Nakayama et al. | 340/768 |
| 3,958,233 | 5/1976 | Schermerhorn | 340/768 |
| 4,104,626 | 8/1978 | Ngo | 340/768 |
| 4,149,112 | 4/1979 | Miwa et al. | 340/768 |

*Primary Examiner*—Marshall M. Curtis
*Attorney, Agent, or Firm*—Ronald D. Slusky

[57] ABSTRACT

An ac plasma panel is provided with self-shift cpability. Alternate columns of discharge sites, of the panel, referred to as "display" columns, hold the display information. The latter is shifted to adjacent "transfer" columns by concurrently applying an excitation pulse to the sites in the display columns and a priming pulse to the sites in the transfer columns. The excitation pulse creates a gas discharge at those display sites which are in the ON state. The excitation and priming pulses, in combination, cause charge from the charge cloud created by each ON-display-site discharge to be transported to the adjacent transfer site. The transported charge represents incipient wall charge for the transfer site and the latter switches to the ON state. An erase pulse is then applied to the display sites. Other pulses are utilized to preclude undesired inter-site interaction.

21 Claims, 16 Drawing Figures

FIG. 4

| CONDUCTOR GROUPS / SHIFTING INTERVALS | φ4 | φ3 | φ2 | φ1 | C2 |
|---|---|---|---|---|---|
| a | | NW | P, SW | X,E,Cc | |
| b | P,SW | X,E,C | Nc,Cc | | CW |
| c | NW | P,SW | X,E,Cc | | |
| d | X,E,Cc | Nc,Cc | | P,SW | X,E,Cc |
| e | P,SW | X,E,Cc | | NW | CW |
| f | Nc,Cc | | P,SW | X,E,Cc | |
| g | X,E,Cc | | NW | P,SW | X,E,Cc |
| h | | P,SW | X,E,Cc | Nc,Cc | |
| a | | NW | P,SW | X,E,Cc | |

SELF-SHIFT AC PLASMA PANEL USING TRANSPORT OF CHARGE CLOUD CHARGE

BACKGROUND OF THE INVENTION

My invention relates to a technique for providing an ac plasma panel with self-shift capability.

A plasma panel is a display device comprised of a body of ionizable gas sealed within a nonconductive, transparent envelope. Alphanumerics, pictures, and other graphical data are displayed by controllably initiating glow discharges (also referred to as "gas discharges") at selected locations within the display gas. This is accomplished by setting up electric fields within the gas via appropriately arranged electrodes, or conductors.

The invention principally relates to so-called twin-substrate ac plasma panels which have the conductors embedded within dielectric layers disposed on two opposing nonconductive surfaces, such as glass plates. Typically, the conductors are arranged in rows on one plate and columns orthogonal thereto on the other plate. The overlappings, or crosspoints, of the row and column conductors define a matrix of discharge cells, or sites. Glow discharges are initiated at selected crosspoints under the control of, for example, a digital computer. The computer initiates a discharge at a selected site via a "write" pulse which is impressed across (applied to) the site by way of its row and column conductor pair. The magnitude of the write pulse exceeds the breakdown voltage of the gas, and a plasma, or "space charge cloud," of electrons and positive ions is created in the crosspoint region. Concomitant avalanche multiplication creates the glow discharge and an accompanying short, e.g., one microsecond, light pulse in the visible spectrum. The write pulse, which continues to be impressed across the site, pulls at least some of the space charge electrons and ions, or charge carriers, to opposite cell walls, i.e., opposing dielectric surfaces in the crosspoint region. When the write pulse terminates, a "wall" voltage resulting from these so-called wall charges remains stored across the gas at the crosspoint.

A single short-duration light pulse cannot, of course, be detected by the human eye. In order to provide a plasma discharge site with the appearance of being continuously light-emitting (ON, energized), further rapidly successive light pulses are needed. These are generated by a sustain signal which is impressed across each site of the panel. The sustain signal is conventionally comprised of a train of alternating-polarity pulses. The magnitude of these sustain pulses is less than the gas breakdown voltage. Thus, the voltage across sites not previously energized by a write pulse is insufficient to cause a discharge and those sites remain in non-light-emitting states.

The voltage across the gas of a site which has received a write pulse, however, comprises the superposition of the sustain signal voltage with the wall voltage previously stored at that site. Conventionally, the sustain pulse which follows a write pulse has a polarity opposite thereto so that the wall and sustain voltages combine additively across the gas. This combined voltage exceeds the gas breakdown voltage and a second glow discharge and accompanying light pulse are created. The flow of carriers establishes an opposite wall voltage polarity. The polarity of the next sustain pulse is also opposite to that of its predecessor, creating yet another discharge, and so forth. After several sustain cycles, the magnitude of the wall voltage is established at a nominally constant, characteristic level which is a function of the gas composition, panel geometry, sustain voltage level, and other parameters. The sustain signal frequency is typically on the order of 40–50 kHz so that the light pulses emitted by an ON site in response to the sustain signal are fused by the eye of the viewer, and the site appears to be continuously light-emitting.

A site which has been established in a light-emitting state is switched to a non-light-emitting (OFF, de-energized) state via the application of an "erase" pulse thereto. The erase pulse creates one last discharge but removes the stored wall charge.

In the past, write and other pulses have been impressed across a selected gas discharge site principally by utilizing so-called half-select techniques in which opposite-polarity signals, each of nominally half the pulse magnitude are applied to the row and column conductors, respectively, of the site in question. These half-select signals are, of course, also thereby extended to each other site in the row and column of the selected site. Since they combine only across the selected site, however, only that site receives a full magnitude pulse and only that site responds thereto.

Disadvantageously, half-select writing and erasing requires an individual driver circuit for each row conductor and each column conductor. Each driver circuit, in turn, is typically comprised of a number of active and passive components. Since a plasma panel may have, for example, 512 row conductors and an equal number of column conductors, the requirement of a driver for each conductor substantially increases the cost, complexity and bulk of the display panel. Accordingly, numerous arrangements have been proposed to minimize the amount of circuitry required to drive an ac plasma panel. Among these are so-called self-shift displays in which the display information for each site in a given row, for example, is entered at one end of the row and is thereafter shifted to the proper column location by applying specially adapted shifting voltage waveforms to the column conductors. Typically, every third or fourth column conductor is connected to a common bus (depending on the specific shifting technique employed) so that only four or five column drivers are required—one for writing and three or four for shifting. Unfortunately, however, the self-shift arrangements known in the art typically suffer from one or more significant drawbacks, including severe signal margin requirements, low shifting speed, poor resolution, limited viewing angle and complex, expensive panel structure.

SUMMARY OF THE INVENTION

The present invention overcomes these and other limitations of the prior art arrangements. In accordance with an important feature of the invention, I have discovered that the state of a first, "display" site of a conventional ac plasma panel can be shifted to a second, adjacent "transfer" site by applying an excitation pulse to the display site and a priming pulse to the transfer site. The shaping of the excitation pulse is such as to initiate a discharge and create a charge cloud in the vicinity of the display site only if it is in the ON state. The shaping of the priming pulse is such that the priming and the excitation pulses, in combination, cause charge carriers from the charge cloud at the discharged display site to be transported to the vicinity of the transfer site. If the display site was ON, it switches OFF at this time—illustratively in response to an erase pulse.

The transported charge carriers provide an initial wall voltage at the transfer site so that the transfer site switches to the ON state. If, on the other hand, the display site was initially OFF, the excitation pulse does not initiate a discharge there. No charge is transported to the transfer site and the latter remains OFF. In this way, the state of the display site, whether ON or OFF, is transferred to the transfer site.

In preferred embodiments of the invention, every other site in each row (assuming horizontal shifting) is a display site. The site to one side or the other of each display site, depending on the direction of shift, is an associated transfer site. In such an arrangement there is a potential back-shifting problem. If it were attempted to shift the states of all display sites to their associated transfer sites concurrently, charge from each ON display site would be transported not only to its associated, downstream transfer site, but to the adjacent, upstream transfer site which is associated with another display site. Thus, even if the latter were OFF, its associated transfer site would, erroneously, switch ON. This potential problem is avoided in accordance with a feature of the present invention by carrying out the shifting process in two steps, in each of which the states of alternate ones of the display sites are shifted to their associated transfer sites.

Various other pulses are applied to the sites of the panel to ensure that the self-shift technique operates with good margins, i.e., that it operates reliably for all sites of a panel and over a reasonably wide range of pulse magnitudes and widths.

BRIEF DESCRIPTION OF THE DRAWING

In the drawing,

FIG. 4 is a chart showing the sequence in which the pulses of FIG. 3 are impressed across the discharge sites in the system of FIG. 1;

DETAILED DESCRIPTION

Figure 1:
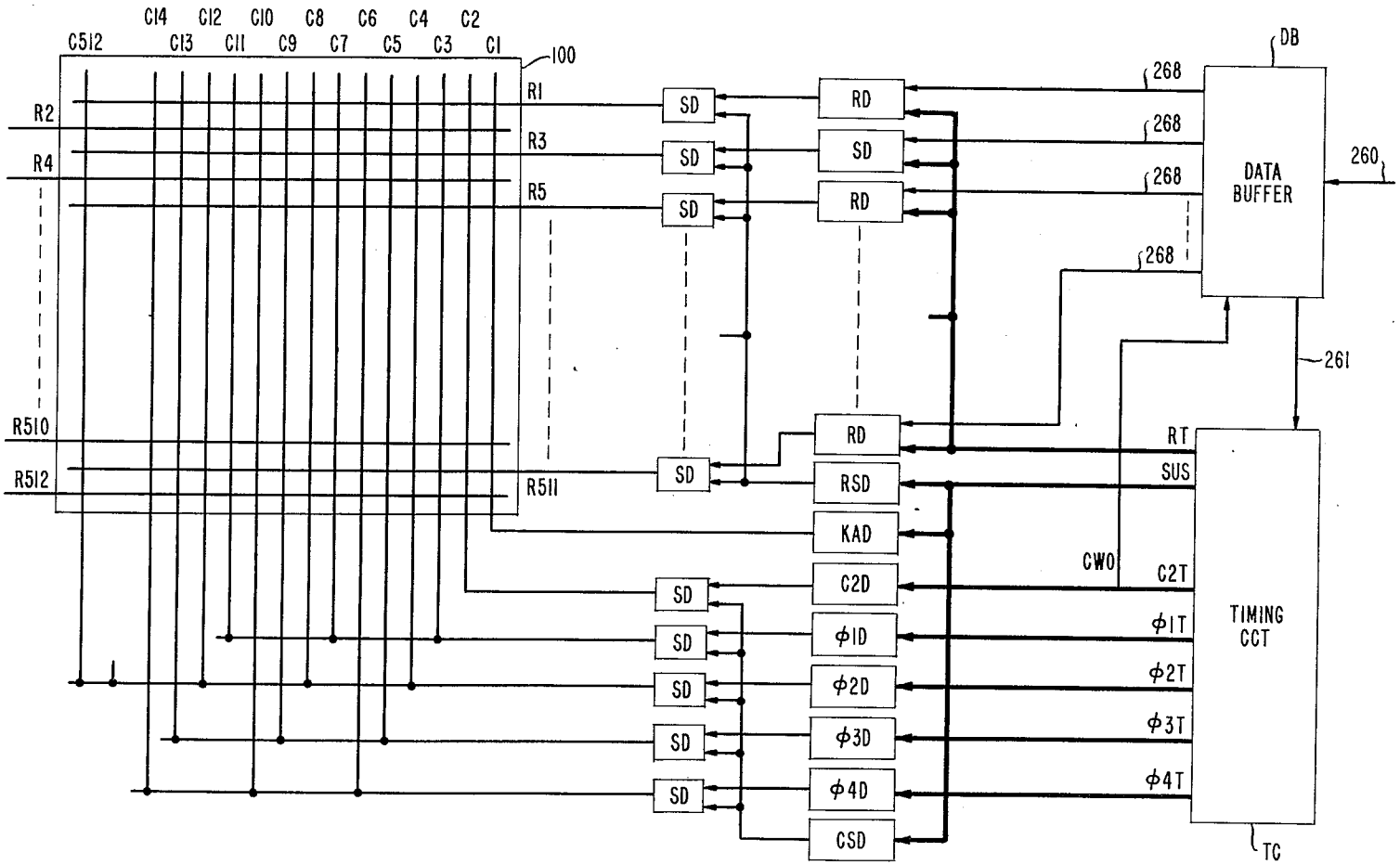
FIG. 1 depicts an ac plasma display system which includes circuitry for implementing the self-shift technique of the present invention.

At the heart of the display system of FIG. 1 is a twin-substrate ac plasma panel 100. Panel 100 is illustratively comprised of two glass plates between which an ionizable gas mixture is sealed. The inner surface of each glass plate is covered by a dielectric layer. A first set of 512 column conductors C1–C512 is embedded in one of the dielectric layers in a generally vertical direction. A second set of 512 row conductors R1–R512 is embedded in the other dielectric layer in a generally horizontal direction. The conductors of each set are spaced at, for example, 60 lines per inch. The individual regions of panel 100 defined by the overlappings, or crosspoints, of the various row and column conductors are referred to as discharge sites. Visual data are presented on the panel by creating glow discharges in the gas at selected crosspoints. Panel 100 is illustratively of the general type disclosed in U.S. Pat. No. 3,823,394 issued July 9, 1974, to B. W. Byrum et al, which is hereby incorporated by reference.

Most ac plasma panel systems are conventional write and erase pulses to switch OFF sites to the ON state and vice versa. The following discussion of the characteristics and operation of such pulses will be found helpful in understanding some of the basic principles of ac plasma panel operation.

Figure 2:
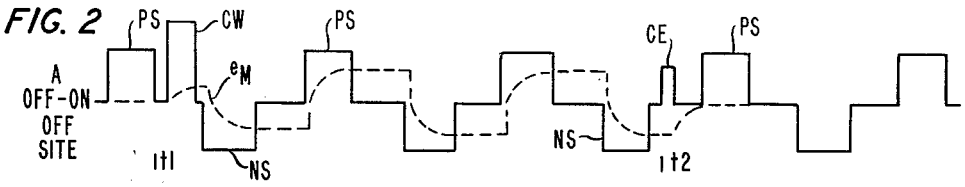
FIG. 2 depicts a signal waveform comprised of conventional ac plasma panel write, erase and sustain pulses.

Waveform A of FIG. 2 depicts a typical conventional write pulse CW. This pulse, shown as beginning at a time $t_1$, is impressed across (applied to) a selected discharge site of an ac plasma panel via the row and column conductor pair associated with that site. The magnitude of pulse CW exceeds the breakdown voltage of the display gas and is thus sufficient to create an initial glow discharge in the gas in the immediate vicinity of the selected site. The glow discharge is characterized by (a) a short, e.g., one microsecond, light pulse in the visible spectrum, and (b) the creation of a plasma, or "space charge cloud," of electrons and positive ions in the vicinity of the site. Pulse CW pulls at least some of these so-called charge cariers to opposite walls of the discharge site, i.e., respective regions of the opposing dielectric surfaces near the crosspoint. Even when pulse CW terminates, a "wall" voltage $e_M$ remains stored across the gas in the crosspoint region. This wall voltage plays an important role in the subsequent operation of the panel, as will be seen shortly.

A single short duration light pulse cannot, of course, be detected by the human eye. In order to provide a discharge site of an ac plasma panel with the appearance of being continuously light-emitting (ON, energized), further rapidly successive glow discharges and accompanying light pulses are needed. These are generated by a sustain signal which is impressed across each site of the panel via its conductor pair. As indicated in waveform A, the sustain signal is illustratively comprised of a train of alternating positive- and negative-polarity sustain pulses PS and NS, respectively. The magnitude of these sustain pulses is less than the breakdown voltage. Thus, the voltage across display sites not previously energized by a write pulse is insufficient to cause a discharge and those sites remain non-light-emitting.

However, the voltage across the gas of a previously energized discharge site comprises the superposition of the sustain signal with the wall voltage $e_M$ previously stored at that site. In particular, the wall voltage created by write pulse CW, for example, combines additively with the following negative sustain pulse NS. This combined voltage exceeds the breakdown voltage so that a second glow discharge and accompanying light pulse occur. The flow of carriers to the walls of the discharge site now establishes a wall voltage of negative polarity. Thus, the following positive sustain pulse PS creates another discharge and wall voltage reversal, and so forth.

As long as at least a particular minimum level of wall charge is stored in response to each of these initial sustain pulses, the wall charge level, and hence the magnitude of wall voltage $e_M$ will build up to a constant, steady-state characteristic level. The sustain signal frequency is typically on the order of 40–50 kHz. Thus, the light pulses created in response to each sustain pulse are fused by the eye of the viewer and the site appears to be continuously light-emitting.

A plasma discharge site already in a light-emitting state is switched to a non-light-emitting (OFF, de-energized) state by removing its wall charge. This is accomplished by an erase pulse, such as conventional erase pulse CE, which begins at a time $t_2$. Again, this pulse is impressed across a particular site by way of its row and column conductor pair. Since positive pulse CE follows a negative sustain pulse NS, pulse CE causes a discharge at an ON site, just as a positive sustain pulse would have. Wall voltage $e_M$ begins to reverse polarity. However, erase pulse CE is of such short duration relative to a sustain pulse that the wall voltage reversal is terminated prematurely. In particular, it is terminated at a time when the wall voltage is less than the minimum necessary to foster further discharges. The discharge site is thus returned to a non-light-emitting state. Any residuum of wall voltage $e_M$ eventually disappears due to recombination of the positive and negative charge carriers and diffusion thereof away from the display site.

Figure 3:
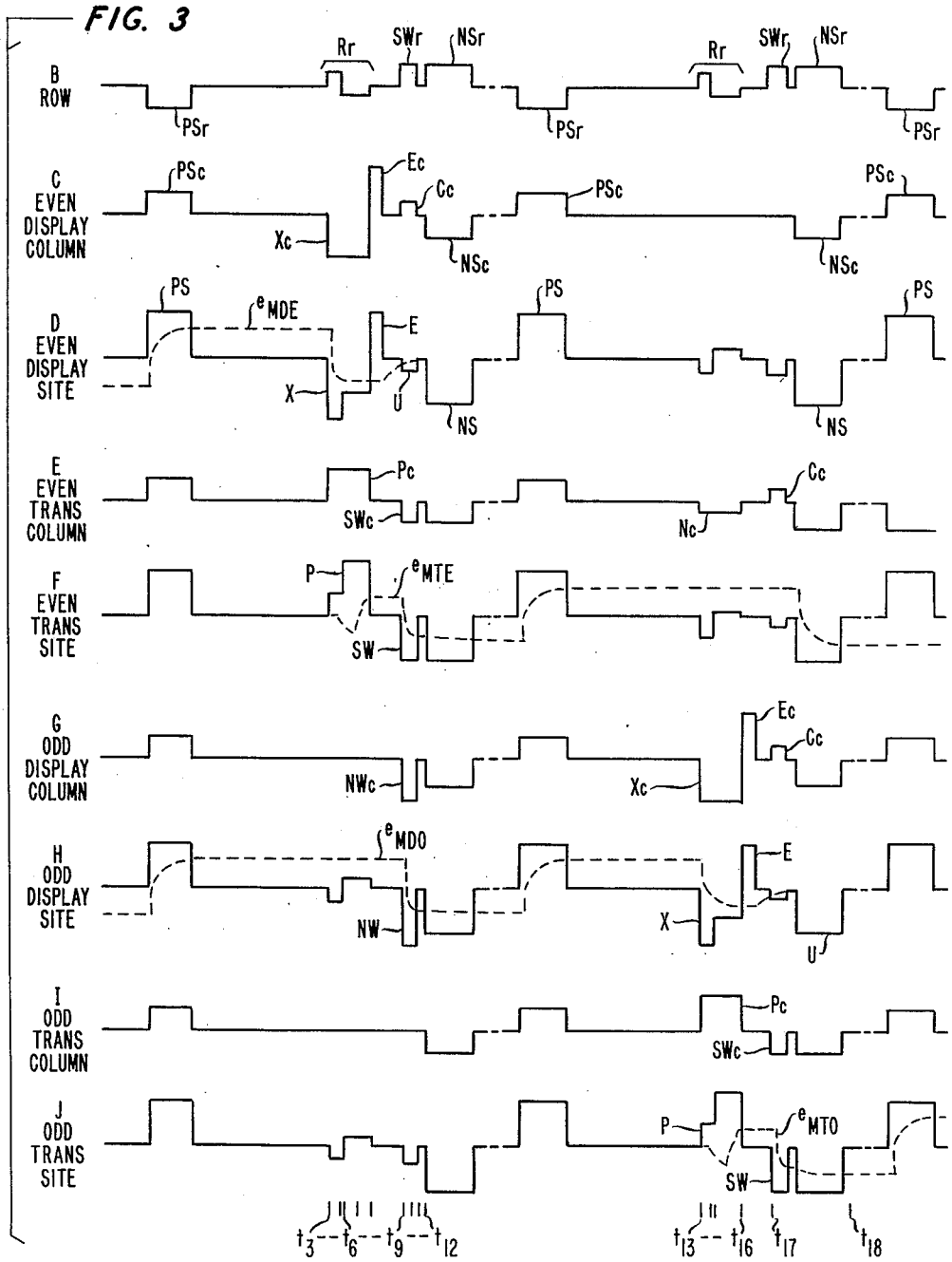
FIG. 3 depicts several signal waveforms comprised of pulses used in the display system of FIG. 1 to provide it with self-shift capability in accordance with the invention.

The shifting of information across panel 100 is achieved in accordance with the self-shift technique of the present invention by applying the signals shown in waveforms B–J of FIG. 3 to the sites of the panel in accordance with the sequence of FIG. 4. Before these signals are described, however, an overview of the self-shift process which they implement will be presented with reference to FIGS. 5–8.

At any point in time, information is displayed on the panel via the energization of selected sites in alternate columns of the plasma panel. The columns in which information is being displayed at any point in time are referred to as "display columns" and the sites therein as "display sites." The intervening columns are referred to as "transfer columns" and the sites therein as "transfer sites."

This format is illustrated in FIGS. 5–8 which depict the upper right corner of panel 100. By way of example, the characters "S" and "P" are shown as being displayed at successive points in the shifting process via the energization of selected sites in the region of the panel defined by row conductors R1–R13 and column conductors C2–C26. (The sites in the column defined by conductor C1 are conventional, always-ON, keep-alive sites. These need not be discussed in further detail except to note that in practice, there are typically several lines of keep-alive sites on each side of the panel rather than the one line of keep-alive sites shown in FIGS. 5–8.)

It is convenient to assign reference characters not only to the spatially fixed column conductors of the panel, i.e., C1–C512, but also to the spatially non-fixed columns of the displayed image. In particular, the column of display sites in which the left-most portion of the character "S" resides is designated DC1. The transfer column to its left is designated TC1. The display and transfer columns to the immediate right of column DC1 are respectively designated DC2 and TC2, and so forth. Since these designations refer to columns in the displayed image, the character "S", for example, always appears in columns TC1–DC5, even though it appears at different ones of the column conductors C2–C512 as the "S" is shifted across the panel.

It will be noticed that only the odd-numbered rows are used to carry display information. This format is not a requirement or limitation of the present invention, but is employed in this embodiment to provide a pleasing aspect ratio for the displayed characters.

Figure 6:
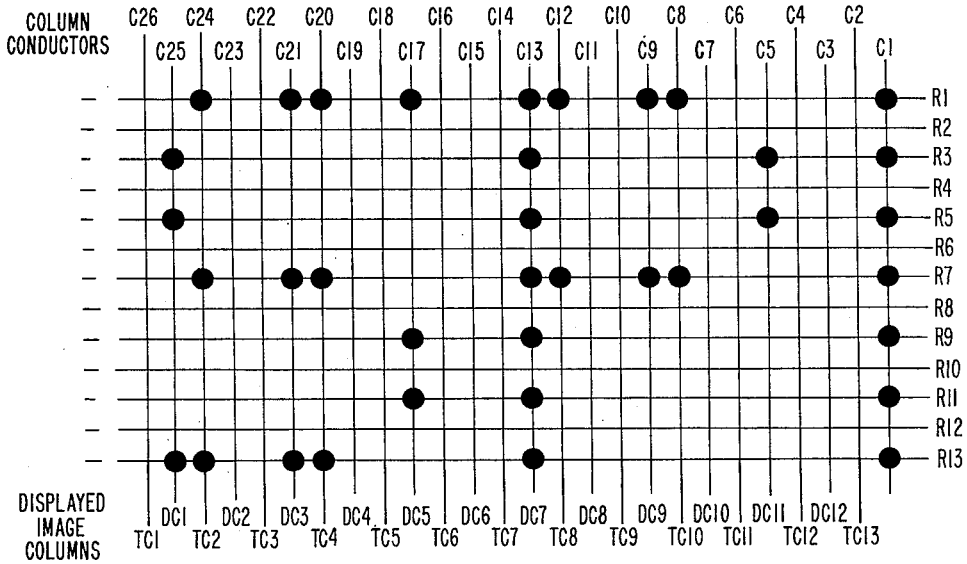
Figure 7:
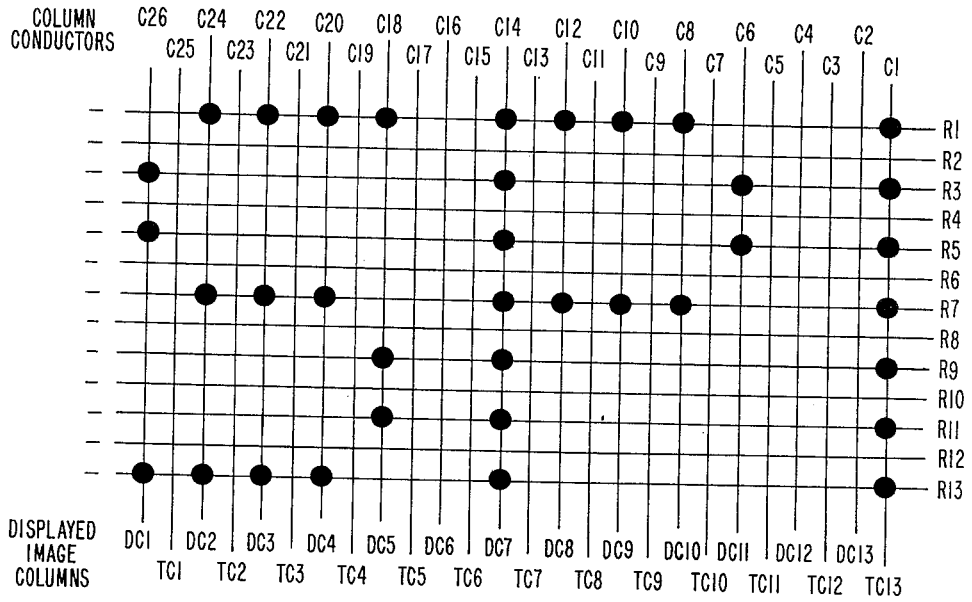
Figure 8:
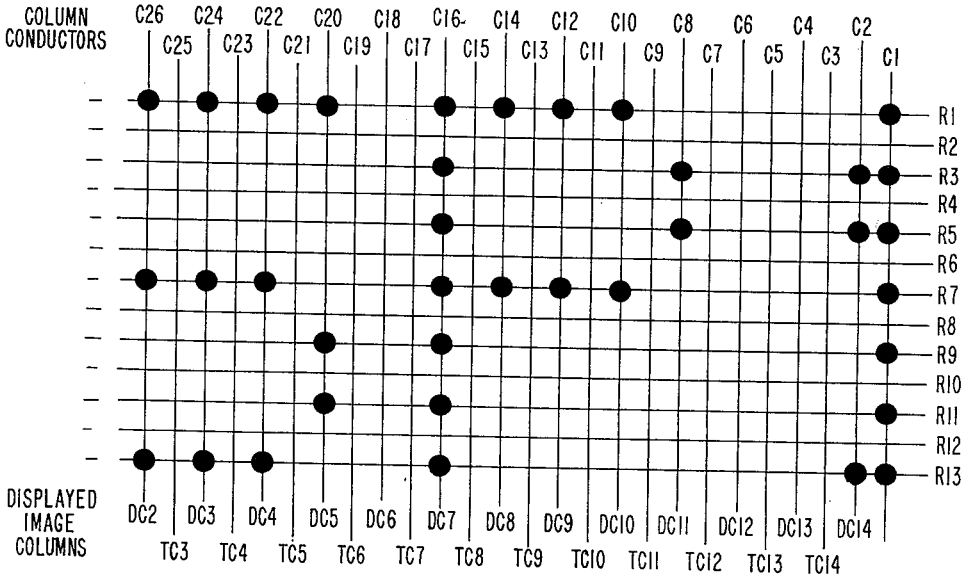

For a reason explained below, the characters displayed on panel 100 are shifted one column to the left in a two-step process. In the first step, the states of the sites in one of the sets of display columns—illustratively the even display columns DC2, DC4, etc.—are shifted along their respective rows to the sites in the even transfer columns TC2, TC4, etc. The resulting pattern of ON sites is shown in FIG. 6. The states of the sites in the other set of display columns, i.e., the odd display columns DC1, DC3, etc., are then shifted in the second step along their respective rows to the odd transfer columns TC1, TC3, etc. As shown in FIG. 7, this completes the desired one-column shift to the left. The displayed characters may be shifted as far to the left as desired by repeating the two-step process. FIG. 8, for example, depicts this portion of the panel after the two-step process has been repeated twice more.

The use of the signals in waveforms B–J to achieve the above-described shifting operation will now be explained with reference to that portion of panel 100 defined by row conductor R1 and column conductors C10–C18. FIGS. 9–15 depict a cross-section of this portion of panel 100 at various points in the shifting process. As shown in these FIGS., row conductor R1 is embedded in a dielectric layer 101 on one side of the body of display gas 103. Column conductors C10–C18 are embedded in a dielectric layer 102 on the other side of the display gas. (The width of the gap between dielectric layers 101 and 102 is exaggerated for drawing clarity.) The crossover regions of row conductor R1 with column conductors C10–C18 define nine discharge sites.

Figure 5:
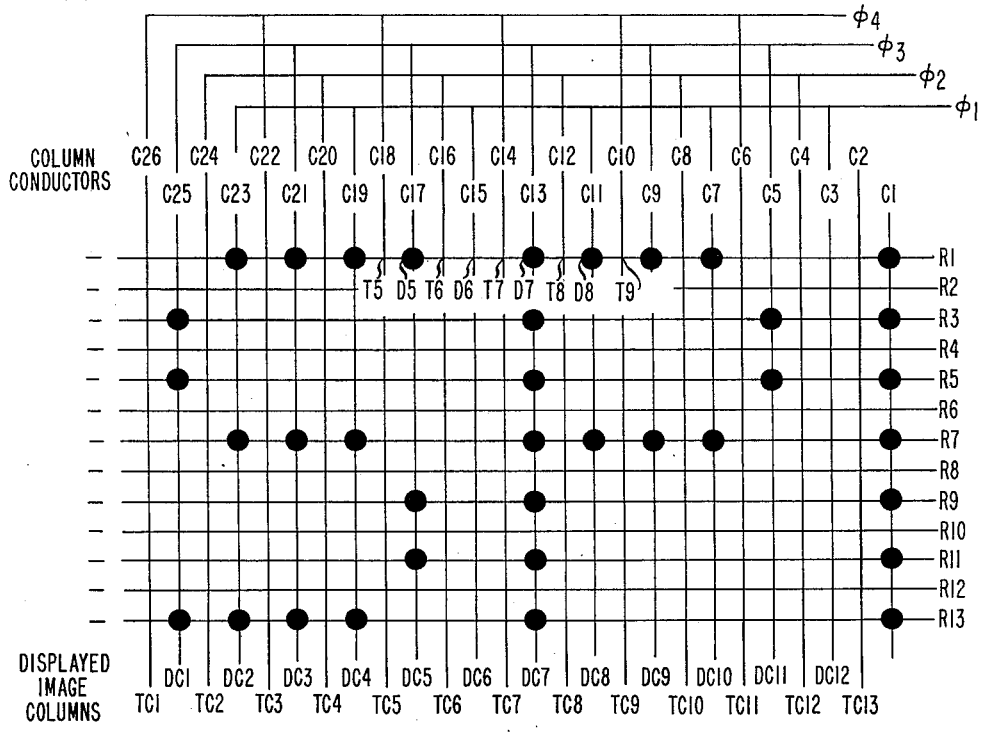
FIGS. 5–8 depict a site state shifting sequence helpful in explaining the principles of the invention.
Figure 9:
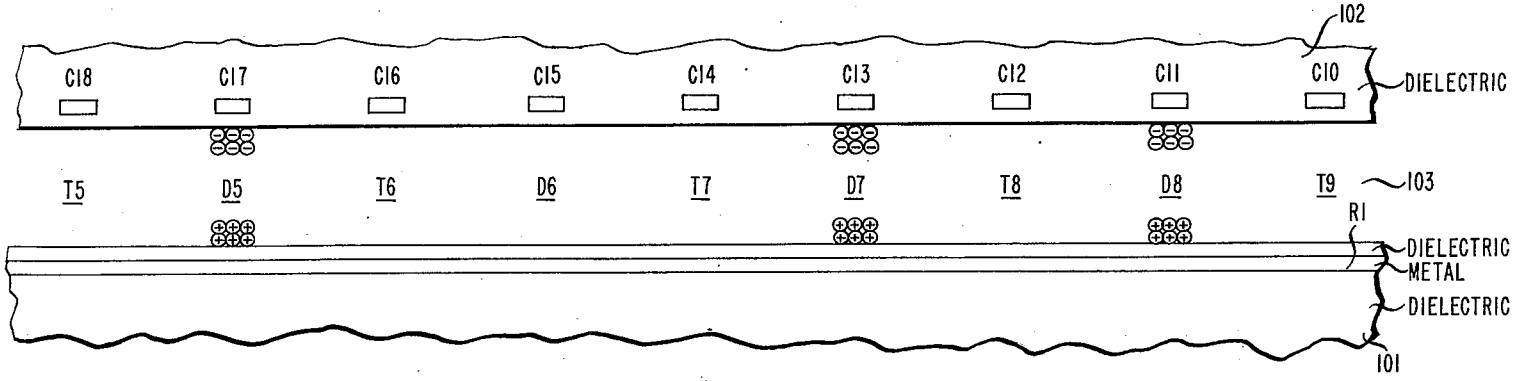
FIGS. 9–15 are cross-sectional views of a portion of the plasma panel used in the display system of FIG. 1.

FIG. 9 illustratively depicts these sites at the same point in time depicted in FIG. 5. Thus, display (transfer) columns DC5, DC6, DC7 and DC8 (TC5, TC6, TC7, TC8 and TC9) are currently positioned at the column locations defined by column conductors C17, C15, C13 and C11 (C18, C16, C14, C12 and C19), respectively. As indicated in FIG. 5 and in FIGS. 9–15, the corresponding display (transfer) sites are designated D5, D6, D7 and D8 (T5, T6, T7, T8 and T9).

The last sustain pulse applied to panel 100 is assumed to have been positive, voltages being measured from the column conductors to the row conductors. Thus, the negative, electron component of the wall charge stored at each ON site is adjacent to dielectric layer 102, while the positive, ion component is adjacent to dielectric layer 101. In conformity with FIG. 5, display sites D5, D7 and D8 are shown in FIG. 9 as being currently in the ON state.

Reference is now made to waveforms B–F of FIG. 3. The shifting of the states of the even display sites to their respective transfer sites begins by impressing an excitation pulse X across the even display sites and concurrently, i.e., in time coincidence, impressing a priming pulse P across the even transfer sites. These pulses begin at time $t_3$ and terminate at time $t_7$. Pulses X and P have a common row component Rr, shown in waveform B. Their column components, Xc and Pc, are shown in waveforms C and E, respectively. Pulses X and P themselves are shown in waveforms D and F, respectively. Waveform D also shows the wall voltage $e_{MDE}$ of On even display sites.

Figure 10:
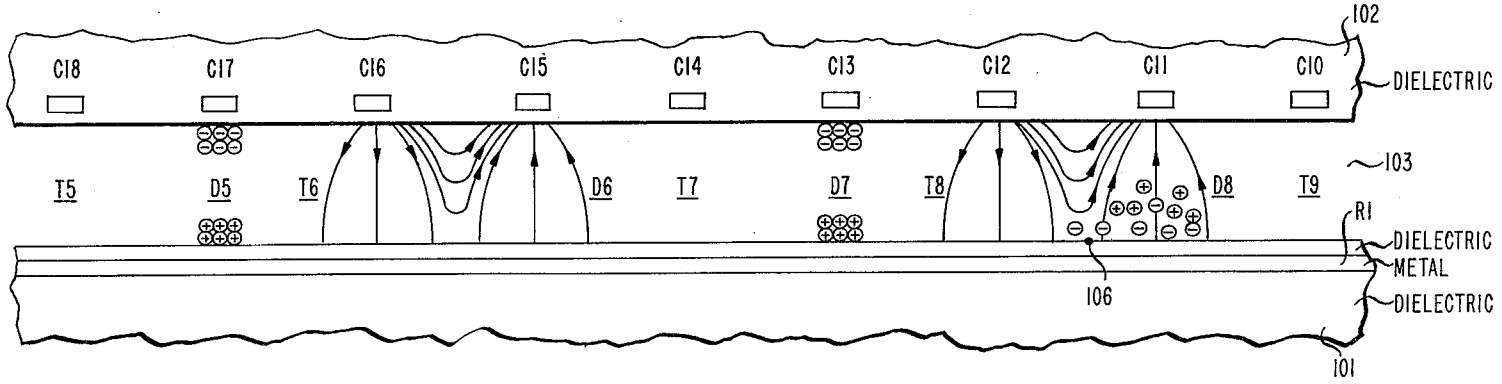

Attention is directed to FIG. 10, which depicts the electric fields and charge distribution at sites T5, D5 . . . T9 at a time $t_4$ just after the onset of pulses X and P. Since pulse X is of negative polarity but has a peak magnitude which is less than the breakdown voltage, it performs much like a negative sustain pulse. That is, it causes a discharge only if wall charge was previously stored at the site to which it is applied, i.e., only if the site is in the ON state. Pulse X thus causes a discharge at even display site D8. Since even display site D6 is OFF, however, pulse X causes no discharge there.

At the point in time depicted in FIG. 10, the space charge cloud of electrons and positive ions has just formed and the negative field gradient at display site D8 has begun to draw electrons toward row conductor R1 and positive ions toward column conductor C11. Many of the electrons have already arrived at or near a surface of dielectric layer 101. The ions move much more slowly than the electrons since they are of considerably greater mass. Thus, few of them have yet reached the surface of layer 102. This movement of electrons and ions is the conventional process by which the polarity of the wall voltage at an ON site—in this case, wall voltage $e_{MDE}$—is reversed when the site receives a sustain or sustain-like signal, e.g., pulse X.

The polarity of column component Pc (illustratively positive) with respect to that of column component Xc (illustratively negative) is such as to create a positive transverse field gradient from transfer site T8 to display site D8. This causes some of the electrons in the charge cloud at display site D8 to be transported along the surface of layer 101 toward transfer site T8 to, for example, point 106. It is this charge transport mechanism which lies at the heart of the present invention.

In particular, waveform F shows that the electrons transported from even display site D8 cause a voltage $e_{MTE}$ to appear at transfer site T8. A portion of this voltage may be due to transported electrons which have not actually reached the wall of transfer site T8. However, those electrons provide the same function as electrons stored at the wall, and $e_{MTE}$ may thus be regarded as a "wall voltage."

Eventually, wall voltage $e_{MTE}$ becomes sufficiently large that, at time $t_6$, its combination with pulse P causes a discharge at transfer site T8. (The voltage needed to initiate a discharge at transfer site T8 is lower than that required to initiate a discharge at a site using conventional write pulse CW, for example. This is because transfer site T8 has been primed with photoelectrons by the discharge which just occurred at display site D8.) Transfer site T8 is thus switched to the ON state.

Since pulse X causes no discharge at display site D6, however, no electrons are transported to transfer site T6. The latter thus remains OFF.

An erase pulse E (waveform D) is impressed across the even display sites subsequent to the onset of pulse X. In this embodiment, more particularly, pulse E occurs from time $t_7$ to time $t_8$, i.e., upon the concurrent termination of pulses X and P. Any of the even display sites which are in the ON state thus switch OFF; any which are OFF remain OFF. The overall effect, then, is that the states of all even display sites are shifted to the corresponding transfer sites. (It may be possible for pulse X to be so shaped as to erase the ON even display sites, thereby precluding the need of a separate erase pulse.)

The dynamics of the wall charge storage at ON display sites in response to pulse X are such that optimum erasure of those sites requires pulse E to have a slightly larger magnitude than conventional erase pulse CE. The magnitude of pulse E is sufficiently small, however, that its full magnitude can be allocated to its column component Ec (waveform C) without causing sites in adjacent columns to be disturbed by the capacitive coupling of component Ec thereto. The row component of pulse E can thus be zero. This is advantageous because it ensures that the states of other sites along the row will not be disturbed, as they might be with a nonzero row component.

It can now be explained why the self-shift technique of the present invention is illustratively carried out in two steps. If excitation pulse X were applied, for example, to odd display site D5 at the same time as it is applied to even display site D6, charge from the former would be transported to transfer site T6, causing that transfer site to be switched to the ON state even though its associated display site D6 is OFF. Shifting the states of the odd and even display sites at different times precludes this so-called back-shifting phenomenon.

It may also be noted at this point that, advantageously, the present self-shift technique does not require the presence of electrical or physical barriers between adjacent rows of the display panel. It might be thought that such are necessary to preclude the transport of charge from a display site in one row to a transfer site in another row. However, the transverse field which transports the charge between sites in a given row is more intense in the vicinity of the row conductor than to the side of it. This tends to focus the transported charge along the path defined by the row conductor, precluding the transport of any significant amount of charge to an adjacent row.

Attention is now re-directed to waveform F. The magnitude of the even transfer site wall voltage $e_{MTE}$ beginning at time $t_7$ may be less than the minimum necessary to ensure that that wall voltage will build up to the steady state sustain-generated characteristic level, i.e., the peak value of wall voltage $e_M$. Thus, if nothing more than a standard negative sustain pulse NS were to be impressed across the now-ON even transfer sites, e.g., at time $t_{12}$, the resulting discharge at at least some of those sites might be weak and even less wall charge would be stored thereat. Such sites would, therefore, eventually return to the OFF state. One solution might be to provide a larger $e_{MTE}$ at time $t_7$ by increasing the magnitude of pulse Pc; I have found that even a modest, e.g., 5-volt, increase in the magnitude of pulse Pc yields a significantly increased transported charge and a stronger breakdown at time $t_6$. Both of these factors would result in a larger $e_{MTE}$ at time $t_7$. Disadvantageously, however, increasing the magnitude of pulse Pc increases the possibility that (a) the states of any ON odd display sites, e.g., site D5, might be disturbed due to an increased capacitive coupling of pulse Pc to the column conductors of these sites, or (b) a transfer site may be switched ON even though its associated display site is OFF.

As shown in waveform F, a preferred way of ensuring that the now-ON even transfer sites remain ON is to impress a shift write pulse SW across them intermediate (between) time $t_9$ and $t_{11}$, i.e., subsequent to the termination of pulse P and prior to the onset of the negative sustain pulse at time $t_{12}$. Pulse SW has a positive row component SWr (waveform B) applied to row conductor R1 and a negative column component SWc (waveform E) applied to the even transfer column conductors. The presence of pulse SW has the effect of widening the negative sustain pulse applied to the even transfer sites. This causes a larger wall voltage to be stored at the even transfer sites by the end of the sustain pulse than would be stored in response to the sustain pulse alone. The magnitude of pulse SW should be sufficiently large to ensure a strong discharge at the now-ON even transfer sites. If pulse SW is too large, however, its row component SWr may disturb the states of other sites along the row. For this reason the onset of pulse SW is made to follow the onset of pulse E by a predetermined, relatively small time interval. This means that at time $t_9$ each now-ON even transfer site will have been primed with photoelectrons from the erase discharge which has just occurred at its associated even display site. The magnitude of pulse SW can thus be lower than it would have to be without such priming.

As previously indicated, the practical effect of applying shift write pulse SW to the even transfer sites is to effectively widen the following negative sustain pulse applied to these sites. As also previously indicated, the shift write pulse, in turn, closely follows erase pulse E. When an erase pulse is closely followed by a sustain pulse, the erased site may "recover." That is, although its wall charge is initially somewhat depleted, the site may not be switched OFF. Rather, the wall charge builds back up over several sustain cycles so that the site which received the erase pulse returns to the ON state. (See, for example, my U.S. Pat. No. 3,851,327, issued Nov. 26, 1974, where this phenomenon is discussed.) Only a portion of pulse SW, i.e., its row component SWr, appears across the even display sites. This may be sufficient, however, for the above-described recovery phenomenon to take place, thereby negating the intended effect of pulse E. The latter could be advanced in time to avoid the ON state recovery problem. However, the above-described advantageous local priming which pulse E provides would then be lost.

The recovery phenomenon is dealt with in the present embodiment, rather, by applying a cancelling pulse Cc to the even display columns (waveform C) during the shift write pulse time slot, i.e., from time $t_9$ to time $t_{11}$. This pulse is of the same polarity as row component SWr. Thus, the overall voltage across the even display sites in the shift write time slot is reduced and recovery of the ON state by the just-erased even display sites does not occur. The magnitude of pulse Cc is illustratively somewhat less than that of row component SWr, leaving an uncancelled residual pulse U (waveform D) across the even display sites. Pulse U is too small, however, to give rise to an ON state recovery problem.

As shown in waveform H, a "neighbor write" pulse NW is impressed across the odd display sites in time coincidence with shift write pulse SW. Pulse NW has a column component NWc (waveform G). Its row component is the row component SWr of pulse SW. The necessity of pulse NW will now be explained with reference to FIG. 11.

Figure 11:
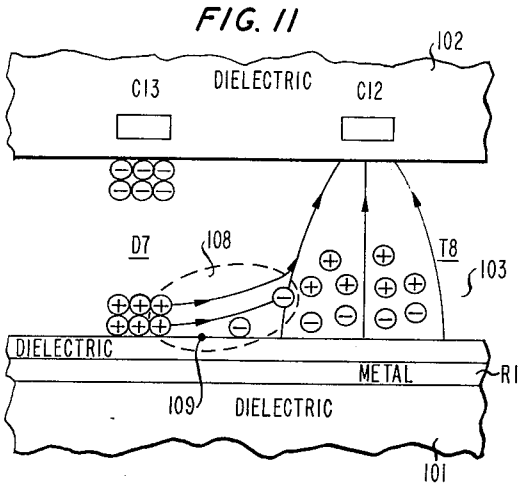

By way of example, FIG. 11 depicts the field lines and charge distribution at sites D7 and T8 which would result at time $t_{10}$ just after the onset of pulse SW if pulse NW were not applied to odd display site D7, also referred to herein as the "left neighbor." When even transfer site T8 experiences a discharge in response to shift write pulse SW, electrons from the resulting charge cloud are pushed toward odd display site D7 along row conductor R1. A local field between these electrons and the wall charge ions of the neighbor is set up in the region 108. This local field combines with the field created by pulse SW itself. This may give rise to a discharge somewhere in the region between the sites, e.g., at point 109. The discharge will be fairly weak, however, and may result in the loss of enough of the wall charge stored at ON odd display site D7 that the latter is erased.

It might be possible to avoid this effect by impressing across site D7 a signal which has the same polarity as pulse SW. This would neutralize the field between sites D7 and T8 and force the electrons back toward the latter. However, a signal of sufficient magnitude to achieve the neutralization might have to be of such a great magnitude as to itself cause a discharge at display site D7. If this is going to happen, the discharge should be a strong one so that a level of wall charge adequate to maintain left neighbor site D7 ON will be restored thereat.

Figure 12:
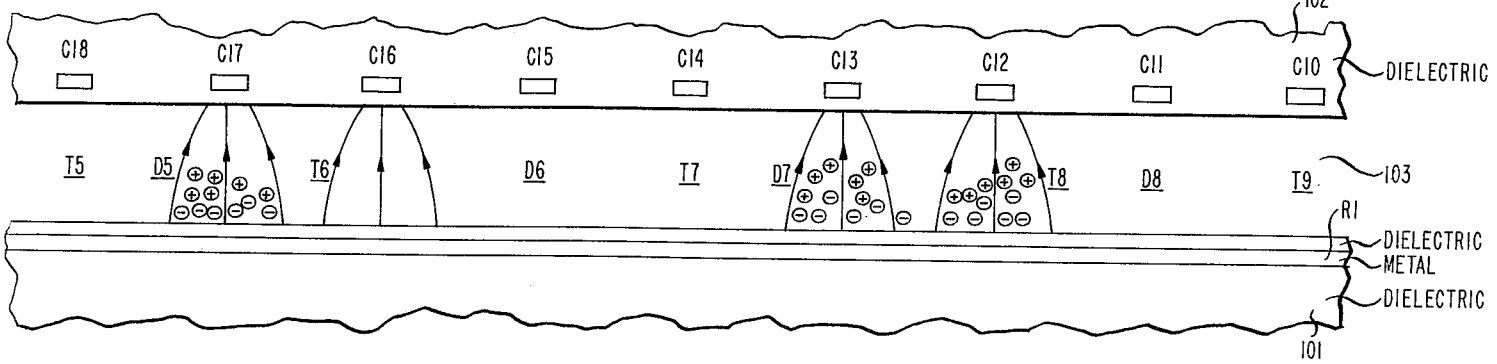

Pulse NW, which is of the same duration as, and concurrent with, pulse SW, but of somewhat greater amplitude, provides this function. FIG. 12 depicts sites T5, D5 . . . T9 at time $t_{10}$ with pulse NW applied. The concurrent application of pulse SW to even transfer site T8 and pulse NW to odd display sites D5 and D7 causes strong discharges at all sites now in the ON state. This ensures that they all remain in that state. (Pulse SW is, of course, also applied to OFF even transfer site T6.) Pulse NW has no effect on odd display sites in the OFF state.

Other signals not discussed above appear across the odd display sites from time $t_3$ to time $t_7$ and across the odd transfer sites from time $t_3$ to time $t_{11}$. These signals result from the fact that row components Rr and SWr are, of necessity, applied to each display and transfer site in the row. These signals are of sufficiently small mangitude, however, that they have no significant effect on the states of the odd display and transfer sites.

At least one, and preferably at least two, sustain cycles are allowed to elapse after time $t_{12}$. This allows the wall voltages at all sites to attain their steady-state, equilibrium magnitudes. The second step of the shifting process—the shifting of the odd display site states to the odd transfer sites—then begins. In particular, pulses X and P are impressed across the odd display and odd transfer sites, respectively, from time $t_{13}$ to time $t_{16}$ to create an incipient wall voltage $e_{MTO}$ at the latter sites.

Figure 13:
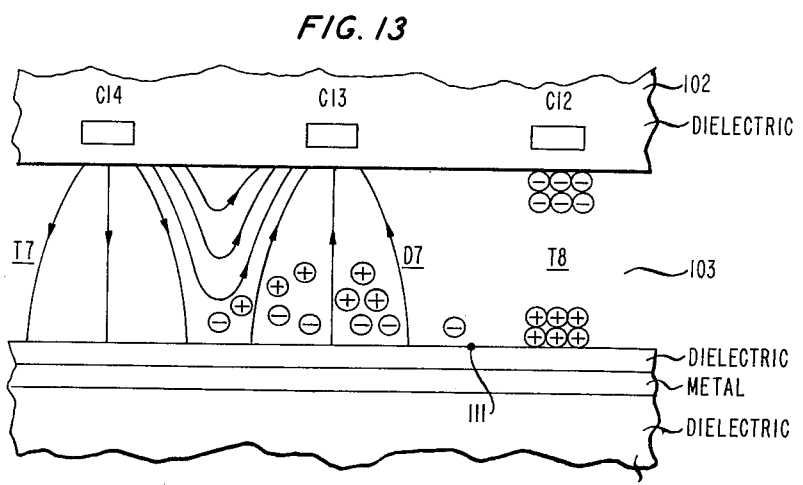

A neutralizing pulse Nc is applied to the even transfer columns at this time. The desirability of pulse Nc may be understood by referring to FIG. 13. By way of example, FIG. 13 depicts the field lines and charge distribution at sites T7, D7 and T8 which would result at time $t_{14}$ just after the onset of pulses X and P if pulse Nc were not applied to the column conductor of even transfer (right neighbor) site T8. When odd display site D7 experiences a discharge in response to excitation pulse X, electrons from the resulting charge cloud are pushed toward site T8, e.g., to point 111, by the fringe field created by pulse X. This effect is enhanced by the wall charge of site T8 if, as in this example, that site is in the ON state.

The result, in either event, is that less charge is transported to transfer site T7—resulting in a smaller wall voltage $e_{MTO}$ at time $t_{16}$—than would be the case if the electrons were prevented from drifting toward site T8. This, in turn, would necessitate a larger magnitude for pulse X. This is disadvantageous. If the magnitude of pulse X were increased by increasing row component Rr, for example, the states of other sites in the row might be disturbed. Increasing column component Xc, on the other hand, increases the chance that the right neighbor sites might be erased via the capacitive coupling of a large Xc to the even transfer site conductors.

Figure 14:
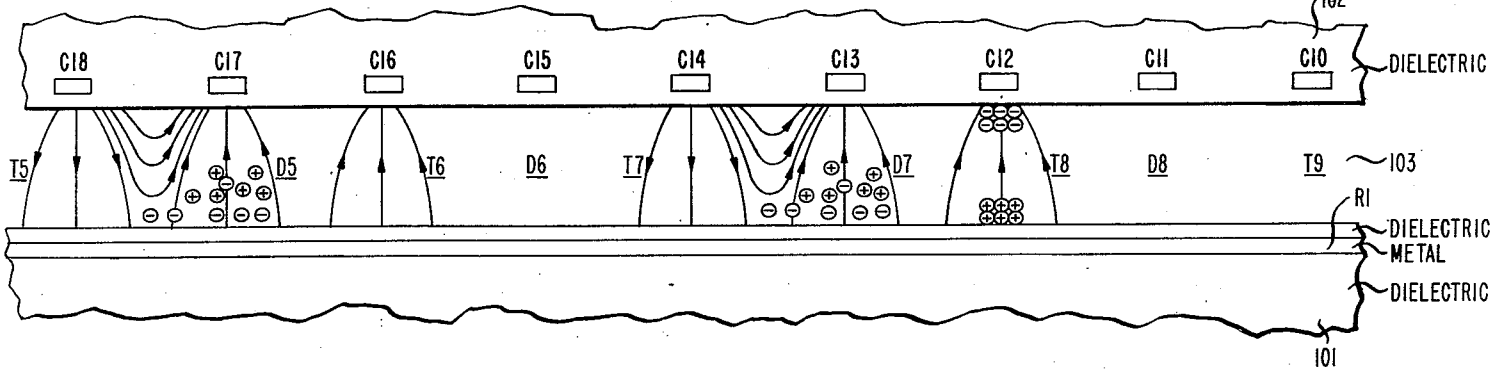

Applying neutralizing pulse Nc to the even transfer conductors effects a more desirable solution. Pulse Nc is of sufficiently small magnitude that it does not disturb the states of the even transfer sites. It is of the same polarity as column component Xc, however. Pulse Nc thus neutralizes the field between the even transfer and odd display sites, precluding the abovedescribed electron drift. The fields resulting from the application of pulse Nc to sites T6 and T8 are shown in FIG. 14, which represents site T5, D5 . . . T9 at time $t_{14}$ with that pulse applied.

Pulses X, P and Nc are followed at time $t_{17}$ by pulse SW impressed across the odd transfer sites and pulse Cc applied to the odd display column conductors. Since the even display sites are all OFF at this time, there is no danger of their being inadvertently erased, as was the case with the odd display sites earlier, i.e., at time $t_9$. Thus, left neighbor write pulse NW is not needed at time $t_{17}$.

In order to prevent states of the even transfer sites from being disturbed by row component SWr, pulse Cc is applied not only to the odd display column conductors but, as shown in waveform E, to the even transfer column conductors as well.

Figure 15:
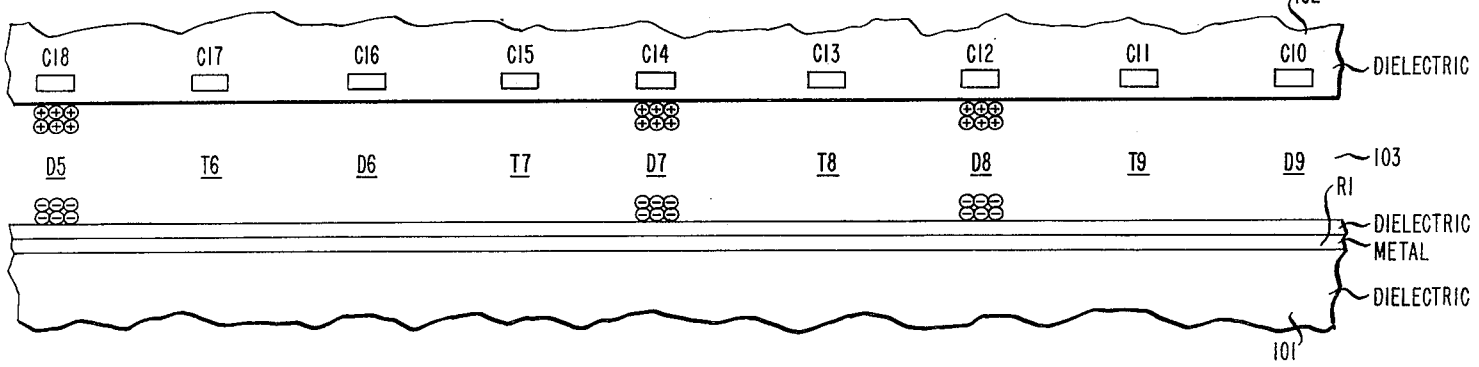

FIG. 15 represents sites T5, D5 . . . T9 at time $t_{18}$, corresponding to the time represented in FIG. 7. Note in FIG. 15 that, as desired, the pattern of ON and OFF sites has been shifted one site to the left.

The shapes of pulses X and P are dictated by the following considerations: The initial portion of pulse X (i.e., times $t_3$–$t_5$ and $t_{13}$–$t_{15}$) has a relatively large magnitude in order to create a large discharge, and hence a large space charge cloud, at the ON display sites to which it is applied. Further to this end, the initial portion of pulse X is made wide enough (but no wider than is necessary) to ensure that the maximum charge cloud is created. This shaping ensures that the amount of charge transported to the transfer sites associated with ON display sites is sufficient to ensure the latter are switched ON reliably. The latter portion of pulse X is made to have a lower magnitude than the initial portion thereof so that even and odd display site wall voltages $e_{MDE}$ and $e_{MDO}$ are relatively small at times $t_7$ and $t_{16}$, respectively. This facilitates erasure of the ON display sites by pulse E.

The termination point of the initial portion of pulse X at times $t_5$ and $t_{15}$ marks the peak of the display site charge cloud density. It is desirable for pulse P to have a relatively large magnitude beginning no later than this time. This ensures that charge is transported as close as possible to the transfer site. It also ensures that the transfer site discharge created by pulse P is as strong as possible. Pulse P illustratively rises to its maximum magnitude in two steps. This protects against the possibility that the pulse will, by itself, switch to the ON state a transfer site whose associated display site is OFF.

The width and peak amplitudes of pulses X and P are such that if these pulses had only non-zero column components—i.e., if column components Xc and Pc were identical to pulses X and P, respectively, and row component Rr were zero—capacitively induced crosstalk effects might cause erroneous erasure during time period $t_{13}$–$t_{16}$ of even transfer sites in the ON state. It is for this reason that a portion of each of pulses X and P is provided via row component Rr.

In an embodiment of the invention which was built and tested, the following pulse magnitudes and widths were found to be appropriate for an Owens-Illinois 512-60 DIGIVUE plasma panel:

| | Magnitude(s) (volts) | Width(s) (μs) |
|---|---|---|
| PS | 100 | 5.0 |
| PSr | −50 | 5.0 |
| PSc | 50 | 5.0 |
| NS | −100 | 5.0 |
| NSr | 50 | 5.0 |
| NSc | −50 | 5.0 |
| Rr | 26, −15 | 1.2, 3.8 |
| X | −121, −80 | 1.2, 3.8 |
| Xc | −95 | 4.0 |
| P | 74, 115 | 1.2, 3.8 |
| Pc | 100 | 4.0 |
| E, Ec | 100 | 2.0 |
| SW | 98 | 1.8 |
| NW | 123 | 1.8 |
| SWr | 53 | 1.8 |
| SWc | −45 | 1.8 |
| NWc | −70 | 1.8 |
| Cc | 31 | 1.8 |
| Nc | −20 | 1.0 |

The time period between pulses E and SW (i.e., from the termination of the former to the onset of the latter) is 1.2 μs; between pulses SW and NS 0.5 μs; between pulses PS and NS 15.0 μs during shifting periods and 5.0 μs during nonshifting periods.

In order to arrive at appropriate pulse magnitudes and widths for plasma panels with different characteristics than the 512-60 DIGIVUE panel, an iterative process may be employed. One possible approach is to first find those widths for the initial and latter portions of pulse X (and thus of pulse P) which provide a maximum in the overall amount of charge transported from an ON display site to the associated transfer site. This is accomplished by assuming magnitudes of the two portions of pulses X and P (such as the values indicated above) and an initial width for pulse SW. The threshold (smallest) magnitude for pulse SW which causes a transfer site discharge is ascertained for various combinations of the pulse X and P widths. The optimum widths are those which result in the minimum threshold magnitude for pulse SW.

An appropriate value for each remaining pulse magnitude and width is ascertained by holding all other parameters at their assumed or previously determined values and then determining the operative range for the parameter in question. The midpoint of that range is then selected as the optimum value. After all parameter values have been arrived at, the process is repeated until their values converge.

New information is introduced onto the panel by selectively energizing sites in a write column, here the column defined by conductor C2. At the point in time depicted in FIG. 8, the first column, DC14, of a second "S" has been written into the write column. In the present illustrative embodiment, energization of selected sites in the write column is effected by applying conventional write pulse CW on a half-select basis to the sites desired to be switched to the ON state. Pulse CW may have a width of 3.0 μsec and amplitude of 160 volts equally divided between row and column components CWr and CWc (not shown in the drawing). Or, a nonconventional write pulse having row and column components of −60 and −100 volts, respectively, and applied during the shift write time slot can be used.

It is anticipated that, as a further alternative, pulses similar to ones shown in waveforms B–J could be used to "shift in" the ON state of the keep-alive sites, i.e., the sites in the column defined by conductor C1, to selected sites in the write column. The width and magnitude parameters of such shift-in pulses would have to be adjusted to take account of the unique characteristics, e.g., larger-than-normal wall voltage, of keep-alive sites. Moreover, each site in the write column which was to remain OFF during "shift-in" (in FIG. 8, the sites in rows R1, R7, R9 and R11) would have to receive an appropriate cancelling signal on its row conductor to preclude shifting in of the ON state of the adjacent keep-alive site.

The timing chart of FIG. 4 shows the sequence of pulses applied to column conductors C2–C512. The pulse sequence applied to conductor C2 is unique to that conductor. Of the remaining conductors, every fourth one receives the same pulses. Thus, as indicated in FIG. 5, column conductors C3–C512 are conveniently regarded as being arranged in four interleaved groups. Conductors C3, C7, etc., are designated as group $\phi_1$. Conductors C4, C8, etc., are designated as group $\phi_2$. Conductors C5, C9, etc., are designated as group $\phi_3$. Conductors C6, C10, etc., are designated as group $\phi_4$. Each horizontal line entry of the timing chart represents the pulses applied to the various conductor groups during each of eight successive shifting intervals a through h. By shifting interval is meant the time period during which the states of one or the other sets of display sites (even or odd) are shifted to their respective transfer sites—corresponding to one step in the abovedescribed two-step shifting process. (Although pulse CW is shown as being applied to conductor C2 during intervals b and e, it is, in reality, applied to conductor C2 one sustain cycle after the other conductors receive their respective pulses during those intervals.)

As in FIG. 5, the conductors in groups $\phi_1$, $\phi_2$, $\phi_3$ and $\phi_4$ are assumed to initially correspond to the even display, even transfer, odd display and odd transfer displayed image columns, respectively. After the elapse of two shifting intervals, the $\phi_2$, $\phi_3$, $\phi_4$ and $\phi_1$ conductors and the ones which correspond to the even display, even transfer, odd display and odd transfer displayed image columns, and so forth. Since the conductors of each group must successively correspond to each of the four types of displayed image columns, the pattern of pulses applied to each conductor group repeats after four complete one-column-to-the-left shifts, i.e., eight shifting intervals.

More particular reference is now made to the display system of FIG. 1. In addition to panel 100, the system includes timing circuit TC, data buffer DB, row and column sustain drivers RSD and CSD, respectively, row drivers RD, column C2 driver C2D, keep-alive driver KAD, column shift drivers $\phi$1D, $\phi$2D, $\phi$3D and $\phi$4D, and steering diode, i.e., OR, gates SD. The above-mentioned drivers may all be similar to the type disclosed, for example, in U.S. Pat. No. 3,754,230 issued Aug. 21, 1973, to E. P. Auger. Data buffer DB may be similar to that shown, for example, in FIGS. 9–10 of U.S. Pat. No. 3,292,156, issued Dec. 13, 1966, to N. H. Stockel. Timing circuit TC may be of the general type disclosed in my U.S. Pat. No. 4,104,626 issued Aug. 1, 1978.

Figure 16:
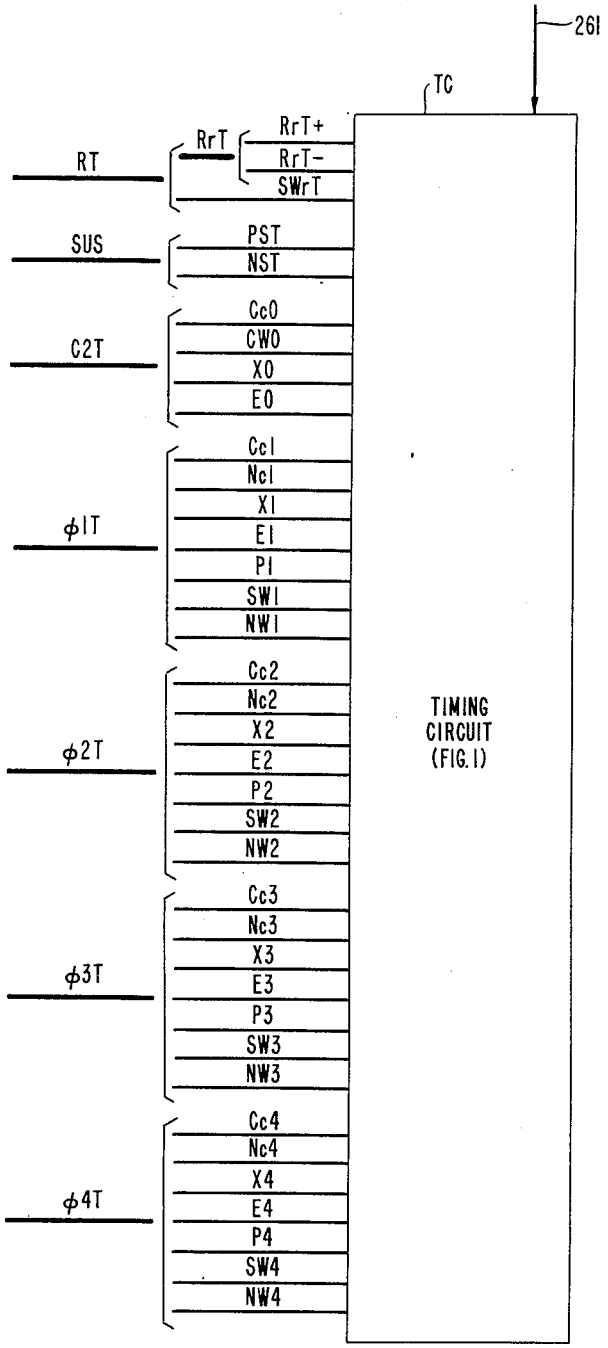
FIG. 16 shows the output leads of a timing circuit used in the system of FIG. 1.

The output signals of timing circuit TC are provided via cables RT (row timing), SUS (sustain), C2T (C2 timing), $\phi$1T ($\phi$1 timing), $\phi$2T, $\phi$3T and $\phi$4T. Each of these cables is comprised of a respective plurality of timing leads, as shown in FIG. 16. For example, timing circuit TC generates signals on leads PST and NST within cable SUS defining the time slots in which positive and negative sustain pulses, respectively, are to be applied to the display sites in the odd-numbered rows of panel 100. Responsive to signal PST (NST), sustain drivers RSD and CSD apply sustain half-select components PSr and PSc (NSr and NSc) to the odd-numbered row conductors and the column conductors of the panel through respective ones of gates SD. The signals on cable SUS are also extended to driver KAD. In response, driver KAD applies to column conductor C1 signals which are similar to pulses PSc and NSc but which are of somewhat greater amplitude. These signals maintain the display sites of column C1 in the ON state at all times to provide conventional keep-alive priming for the panel.

Beginning with column C3, every fourth column of panel 100 receives the same pulse sequence, as previously indicated. In particular, timing circuit TC generates logic level signals on leads Ccl, Ncl, X1, E1, P1, SW1 and NW1 within cable $\phi$1T. These signals respectively define the times during each block of eight shifting intervals when pulses Cc and Nc and the column components of pulses X, E, P, SW and NW are to be applied to column conductors C3, C7, etc. Column driver $\phi$1D responds to each signal on the leads within cable $\phi$1T to extend the appropriate pulse or column component to column conductors C3, C7, etc., by way of the associated one of gates SD.

Conductors C4, C8, etc., similarly receive the output of driver $\phi$2D, while conductors C5, C9, etc., receive the output of driver $\phi$3D and conductors C6, C10, etc., receive the output of driver $\phi$4D. The signals received, and the pulses generated, by drivers $\phi$2D, $\phi$3D and $\phi$4D are the same as those of driver $\phi$1D, but each delayed two shifting intervals with respect to the previous one, as can be seen from FIG. 4. To achieve this, appropriate timing signals for pulses Cc and Nc and for the column components of pulses X, E, P, SW and NW are provided to driver $\phi$2D via leads Cc2, Nc2, X2, E2, P2, SW2 and NW2, respectively, of cable $\phi$2T; to driver $\phi$3D via leads Cc3, Nc3, X3, E3, P3, SW3 and NW3, respectively, of cable $\phi$3T; and to driver $\phi$4D via leads Cc4, Nc4, X4, E4, P4, SW4 and NW4, respectively, of cable $\phi$4T.

In a similar manner, conductor C2 receives pulse Cc and the column components of pulses CW, X and E from driver C2D. The latter, in turn, is responsive to logic level signals on leads CcO, CWO, XO an EO of cable C2T.

The odd-numbered row conductors receive row components Rr and SWr from row drivers RD again via respective ones of gates SD. Drivers RD generate those components in response to logic level signals on leads RrT+, RrT− and SWrT of cable RT. The timing signals on leads RrT+ and RrT−, which together comprise a cable RrT within cable RT, respectively define the time slots for the positive and negative portions of row component Rr. The timing signals on lead SWrT define the time slot for the row component of pulse SW (and thus of pulse NW).

A tap off of lead CWO of cable C2T is explicitly shown in FIG. 1. This lead carries a signal during the time slot in which conventional write pulse CW is to be applied to the desired sites in the column defined by conductor C2. Lead CWO extends not only to column driver C2D but also to data buffer DB.

Data buffer DB has a plurality of logic level output leads 268, each connected to a different one of row drivers RD. The buffer responds to the signal on lead CWO by providing logic level "1"s on individual ones of its output leads 268 in accordance with the OFF and ON pattern to be presented in the write column, i.e., the column defined by conductor C2. Each row driver receiving a "1" on its associated one of leads 268 extends the row half-select component of pulse CW, row component CWr, to the associated row conductor via the associated one of gates SD. Since only column C2 receives the column half-select component CWc of pulse CW, the only sites affected by the row half-select component CWr are those sites in the write column which are to be switched ON. (Components CWr and CWc are not shown explicitly in the drawing.)

Circuit TC continuously provides the abovedescribed timing signals on cable SUS during non-shifting periods to continuously generate the sustain signal necessary to maintain whatever sites are currently in the ON state in that state. At the same time, data buffer DB receives over lead 260 new information to be shifted onto the panel. Lead 260 may extend from a digital computer, for example, or other data processor. When shifting is to commence, buffer DB provides a logic level "1" to timing circuit TC over lead 261. The latter, in response, begins to generate the sequence of logic level signals necessary to generate the pulse sequence of FIG. 4. Whenever the buffer is empty, the signal on lead 261 returns to "0". Circuit TC continues in the shifting mode through the next-occurring one of shifting intervals d or h and then returns to the pure sustain mode.

In the present illustrative embodiment, display information is shifted only horizontally, i.e., along the row conductors. If desired, however, the present self-shift technique could be used to shift display information vertically along the column conductors. This would simply involve the application of the above-described column conductor signals to the row conductors and vice versa.

Moreover, an ac plasma panel system embodying the principles of the invention could be configured to provide both horizontal and vertical shifting. In one possible such arrangement, display information in the form of alphanumeric characters, for example, could be shifted onto the panel in a lower section comprised of, say, the bottom seven rows and thereafter shifted up into the remaining, upper section. Of course, information displayed in the upper section would have to be prevented from shifting horizontally while information is shifted into the lower section. This could be accomplished, for example, by electrically isolating the upper- and lower-section column conductors or by replacing component Rr with an appropriate excitation canceling signal along the upper-section row conductors. Such a canceling signal might have, for example, a magnitude of $-20$ volts for 2.0 $\mu$s and $+33$ volts for 2.0 $\mu$s.

It is anticipated that the principles of the invention could be used to provide self-shift capability for single substrate ac plasma panels, such as that shown in U.S. Pat. No. 4,164,678 issued Aug. 14, 1979, to M. R. Biazzo et al.

It will thus be appreciated that the specific embodiment of the invention shown and described herein is merely illustrative. Those skilled in the art will be able to devise many and varied arrangements embodying the principles of the invention without departing from the spirit and scope thereof.

I claim:

1. Circuitry for use in a display system which includes at least first and second adjacent ac gas discharge sites, said circuitry characterized by first means for impressing an excitation pulse across said first site, said excitation pulse being such as to create a charge cloud in the vicinity of said first site only if it is in the ON state and second means for impressing a priming pulse across said second site in such a way as to create a positive field gradient from said second site to said first site beginning at substantially the same point in time that said charge cloud is created, whereby charge carriers from said charge cloud are transported to the vicinity of said second site.

2. The invention of claim 1 wherein said circuitry is further characterized by means including said second means for switching said second site from the OFF state to the ON state in response to the presence of said transported charge carriers in the vicinity of said second site, and wherein said second means is adapted to impress said priming pulse across said second site when said excitation pulse is impressed across said first site.

3. The invention of claim 2 wherein said switching means includes sustain means for impressing alternating-polarity sustain signals across at least said second site.

4. Circuitry for use in a display system which includes at least first and second adjacent ac gas discharge sites, said circuitry characterized by first means for sequentially impressing an excitation pulse and an erase pulse across said first site, said excitation pulse being such as to create a charge cloud in the vicinity of said first site only if it is in the ON state and said erase pulse being such as to switch said first site to the OFF state if it is in the ON state and second means for impressing a priming pulse across said second site in such a way as to create a positive field gradient from said second site to said first site beginning at substantially the same point in time that said charge cloud is created, whereby charge carriers from said charge cloud are transported to the vicinity of said second site.

5. A display system comprised of an array of ac gas discharge sites, sustain means for alternately applying first- and second-polarity sustain signals to each of said sites concurrently, each of said sustain signals initiating a gas discharge at ones of said sites having at least a predetermined minimum level of stored charge and causing at least said minimum level of stored charge to be maintained at said ones of said sites, characterized by first means for applying an excitation signal of said second polarity to a first one of said sites subsequent to a first-polarity one of said sustain signals and prior to a second-polarity one of said sustain signals, said excitation signal being shaped so as to initiate a gas discharge and charge cloud at said first site only if said first site has at least said minimum level of stored charge, and second means operative beginning at substantially the same point in time that said charge cloud is created for transporting a portion of said charge cloud to the vicinity of a second one of said sites which initially has less than said minimum level of stored charge, and third means for causing at least said minimum level of charge to be stored at said second site in response to the presence of said charge cloud portion in the vicinity of said second site.

6. The invention of claim 5 wherein said second means includes means for applying to said second site a priming signal of said first polarity, at least a portion of said priming signal being time-coincident with said excitation signal.

7. The invention of claim 6 wherein said first and second polarities are such that the combination of said excitation and priming signals creates a positive field gradient from said second site to said first site.

8. A display system comprised of an array of ac gas discharge sites, sustain means for alternately applying first- and second-polarity sustain signals to each of said sites concurrently, each of said sustain signals initiating a gas discharge at ones of said sites having at least a predetermined minimum level of stored charge and causing at least said minimum level of stored charge to be maintained at said ones of said sites, characterized by first means for applying an excitation signal of said second polarity to a first one of said sites subsequent to a first-polarity one of said sustain signals and prior to a second-polarity one of said sustain signals, said excitation signal being comprised of first and second portions having first and second magnitudes during first and second time intervals, respectively, said second magnitude being less than said first magnitude, said first magnitude being such that said excitation signal initiates a gas discharge and charge cloud at said first site only if said first site has at least said minimum level of stored charge, second means for transporting a portion of said charge cloud to the vicinity of a second one of said sites which initially has less than said minimum level of stored charge, said second means including means for applying to said second site a priming signal of said first polarity, at least a portion of said priming signal being time-coincident with said excitation signal, and said first and second polarities being such that the combination of said excitation and priming signals creates a positive field gradient from said second site to said first site, and third means for causing at least said minimum level of charge to be stored at said second site in response to the presence of said charge cloud portion in the vicinity of said second site.

9. The invention of claim 9 wherein said excitation signal is comprised of a first component which has said second polarity and substantially constant magnitude and a second component which has said first and second polarities during said first and second time intervals, respectively, wherein said priming signal is comprised of a first component which has said first polarity and substantially constant magnitude and a second component which is the same as the second component of said excitation signal, wherein said first means includes means for applying the first component of said excitation signal to said first site, wherein said second means includes means for applying the first component of said priming signal to said second site and wherein said first and second means jointly include means for applying the second half-select components of said excitation and priming signals concurrently to said first and second sites.

10. The invention of claims 6, 7 or 9 wherein said third means includes means for initiating a gas discharge at said second site at a first predetermined time subsequent to the termination of said priming signal and prior to the onset of said second polarity one of said sustain signals.

11. The invention of claim 10 further characterized by means for initiating a gas discharge at a third one of said sites substantially at said predetermined time, said third site being collinear in said array with said first and second sites and adjacent to said second site.

12. The invention of claim 11 further characterized by means for applying an erase signal to said first site subsequent to the onset of said excitation signal, said erase signal causing said first site to have less than said minimum level of stored charge if it theretofore had at least said minimum level of stored charge.

13. The invention of claim 11 further characterized by means for applying an erase signal to said first site at a second predetermined time subsequent to the onset of said excitation signal, said erase signal initiating a gas discharge at said first site and causing said first site to have less than said minimum level of stored charge if it theretofore had at least said minimum level of stored charge, said second predetermined time being such that said second site is primed at said first predetermined time by the discharge initiated by said erase signal.

14. The invention of claims 6, 7 or 9 wherein said third means is comprised of means for applying a shift write signal of said second polarity to said second site subsequent to the termination of said priming signal, the magnitude of said shift write signal being such as to initiate a gas discharge at said second site at a predetermined point in time only if said charge cloud portion was transported to said second site.

15. The invention of claim 14 further characterized by means for applying a neighbor write signal of said second polarity to a third one of said sites concurrently with the application of said shift write signal to said second site, said third site being collinear in said array with said first and second sites and adjacent to said second site and the magnitude of said neighbor write signal being such as to initiate a gas discharge at said third site only if said third site has at least said minimum level of stored charge.

16. The invention of claim 14 further characterized by means for applying an erase signal to said first site subsequent to the onset of said excitation signal and prior, by a predetermined time interval, to the onset of said shift write signal, said erase signal initiating a discharge at said first site and causing said first site to have less than said minimum level of stored charge if it theretofore had at least said minimum level of stored charge, said predetermined time interval being such that said second site is primed at said predetermined point in time by the discharge initiated by said erase signal.

17. Circuitry for use in a gas discharge display system of the type which includes at least a first row of ac gas discharge sites, each successive plurality of four of said sites being comprised of an even display site, an associated even transfer site, an odd display site and an associated odd transfer site in the order named, said circuitry including sustain means for alternately applying positive- and negative-polarity sustain pulses across each of said sites concurrently, said sustain signals causing a gas discharge, and at least a minimum level of charge to be stored, at ones of said sites which are in the ON state, characterized by first means for applying a first negative-polarity excitation pulse and a first positive-polarity priming pulse concurrently to each even display and even transfer site, respectively, during a first time interval and second means for applying a second excitation pulse and a second priming pulse to each odd display and odd transfer site, respectively, during a second time interval, said first time interval being intermediate a first positive-polarity sustain pulse and a first negative-polarity sustain pulse, and said second time interval being intermediate a second positive-polarity sustain pulse and a second negative-polarity sustain pulse, each of said excitation pulses being shaped so as to create a gas discharge and charge cloud only at ON ones of the display sites to which it is applied and each of said excitation and priming pulses being shaped such that a portion of the charge cloud created at each ON display site is transported to the associated transfer site, third means for causing at least said minimum level of charge to be stored only at each even transfer site to which a charge cloud portion was transported and fourth means for causing at least said minimum level of charge to be stored only at each odd transfer site to which a charge cloud portion was transported.

18. The invention of claim 17 further characterized by means for applying a first erase pulse to each even display site intermediate the onset of said first excitation pulse and the onset of said first negative-polarity sustain pulse, and means for applying a second erase pulse to each odd display site intermediate the onset of said second excitation pulse and the onset of said second negative-polarity sustain pulse, said first and second erase pulses respectively switching each even and odd ON display site to the OFF state.

19. The invention of claims 17 or 18 wherein said third means includes means for applying a first negative-polarity shift write pulse to each even transfer site intermediate the termination of said first priming pulse and the onset of said first negative-polarity sustain pulse, and wherein said fourth means includes means for applying a second negative-polarity shift write pulse to each odd transfer site intermediate the termination of said second priming pulse and the onset of said second negative-polarity sustain pulse, said first and second shift write pulses each having a magnitude sufficient to initiate a gas discharge at each even and odd transfer site, respectively, to which a charge cloud portion was transported.

20. The invention of claim 19 further characterized by means for applying a negative-polarity neighbor write pulse to each odd display site concurrently with the application of said first shift write pulse to each even transfer site, the magnitude of said neighbor write pulse being such as to cause a gas discharge at each odd display site which is in the ON state during said first time interval.

21. The invention of claim 20 further characterized by means for applying a negative-polarity neutralizing pulse to each even transfer site in time coincidence with said second excitation pulse and said second priming pulse, said neutralizing pulse having a magnitude which is insufficient to cause a change in the state of said each even transfer site.

* * * * *